US007609140B2

(12) United States Patent
Fukui

(10) Patent No.: US 7,609,140 B2
(45) Date of Patent: Oct. 27, 2009

(54) MOLDED BODY

(75) Inventor: Yoshizumi Fukui, Hiki-Gun (JP)

(73) Assignee: Toko, Inc., Tokyo (JP)

( * ) Notice: Subject to any disclaimer, the term of this patent is extended or adjusted under 35 U.S.C. 154(b) by 0 days.

(21) Appl. No.: 12/353,827

(22) Filed: Jan. 14, 2009

(65) Prior Publication Data

US 2009/0184791 A1 Jul. 23, 2009

(30) Foreign Application Priority Data

Jan. 18, 2008 (JP) ..... 2008-008949
Oct. 24, 2008 (JP) ..... 2008-274067

(51) Int. Cl.
*H01F 27/29* (2006.01)

(52) U.S. Cl. ..... 336/192; 336/233

(58) Field of Classification Search ..... 336/90, 336/92, 96, 192, 233
See application file for complete search history.

(56) References Cited

FOREIGN PATENT DOCUMENTS

| | | |
|---|---|---|
| JP | 01-199413 | 8/1989 |
| JP | 05-304018 | 11/1993 |
| JP | 06-290948 | 10/1994 |
| JP | 2005-228827 | 8/2005 |
| JP | 2007-165779 | 6/2007 |

*Primary Examiner*—Ramon M Barrera
(74) *Attorney, Agent, or Firm*—Cohen Pontani Lieberman & Pavane LLP

(57) ABSTRACT

There is provided a molded body having high fixing strength between a magnetic mold material and an external electrode. The molded body uses the magnetic mold material comprising at least 65 vol % of magnetic powder and up to 35 vol % of resin and the external electrode that has pits and projections on a surface that makes contact with the magnetic mold material. The external electrode and the magnetic mold material are integrally-molded such that at least a portion of the external electrode is exposed at at least one surface of the molded body. Spacing between the pit and projection of the external electrode is smaller than the maximum particle size of the magnetic powder.

3 Claims, 4 Drawing Sheets

5 μm

5 μ m

MOLDED BODY

BACKGROUND OF THE INVENTION (i) Field of the Invention

The present invention relates to a molded body comprising at least 65 vol % of magnetic powder, particularly to a technique for increasing fixing strength between a magnetic mold material and an external electrode.

(ii) Description of the Related Art

Technological innovations in reducing the sizes and increasing the speeds of electronics in recent years are remarkable. Along with them, a reduction in the sizes and an improvement in the performances of electronic parts such as a mold coil have been desired. To reduce the size and improve the performance of the mold coil, magnetic materials showing high performance such as high magnetic permeability and excellent moldability have been desired, in particular.

Heretofore, magnetic mold materials having excellent magnetic properties as exemplified by high magnetic permeability have been studied. Japanese Patent Application Laid-Open No. 304018/1993 discloses a magnetic mold material having magnetic properties improved by comprising at least 60 vol % of amorphous alloy powder.

When an external electrode is integrally-molded into a molded body used for the mold coil or the like, the external electrode is directly brought into contact with and fixed to a magnetic mold material without use of an adhesive. The magnetic mold material primarily comprises magnetic powder and a resin. The magnetic powder has no adhesion, and the resin has adhesion. The surface of the external electrode makes contact with both the resin having adhesion and the magnetic powder having no adhesion.

In the case of conventional, common magnetic mold materials, the proportion of the resin is as high as at least 50 vol %, and the surface of the external electrode can contact the resin to a sufficient extent. Accordingly, high fixing strength can be attained even if the external electrode is integrally-molded. However, if the proportion of the magnetic powder in the magnetic mold material is increased to improve magnetic properties, the proportion of the resin is inevitably decreased. When the proportion of the resin in the magnetic mold material is decreased, the resin cannot make contact with the surface of the external electrode to a satisfactory extent. As a result, the fixing strength of the external electrode deteriorates, and the external electrode may fall off.

TABLE 1

| | Compounding Ratio [wt %] | | Magnetic Powder | Fixing |
|---|---|---|---|---|
| Sample | Magnetic Powder | Resin | Volume Filling Rate [vol %] | Strength [kgf] |
| 1 | 85 | 15 | 49 | 2.2 |
| 2 | 92 | 8 | 66 | 0.8 |

TABLE 1 shows the fixing strengths of the external electrodes of molded bodies obtained by use of magnetic mold materials differing in the filling rate of magnetic power. Hereinafter, samples 1 and 2 shown in TABLE 1 will be described. The external electrodes of the samples 1 and 2 were prepared by use of a rolled phosphor bronze plate. The rolled phosphor bronze plate has been commonly used as a material for the external electrode. Further, the samples 1 and 2 use magnetic mold materials prepared by blending silicon steel (Fe—Si based) powder having a maximum particle size of 45 μm with a novolac epoxy resin in the compounding ratios shown in TABLE 1. The external electrodes and the magnetic mold materials were press-molded to obtain molded bodies each having 2.8 mm on a side. The molded bodies of the samples 1 and 2 are formed in the same manner as the molded body of the present invention to be described later is formed and have the same external configuration as that of the molded body of the present invention. Further, measurements of the fixing strengths of the samples 1 and 2 were made in the same manner as described in a suitable embodiment of the present invention. Details thereof will become apparent by referring to the suitable embodiment of the present invention.

As is clear from TABLE 1, the sample 1 having a magnetic powder filling rate of about 50 vol % has a fixing strength of 2.2 kgf. In the case of an electronic part having about 3 mm on a side, it must retain an external electrode fixing strength of generally at least 12 N (1.22 kgf), preferably at least 15 N (1.53 kgf). Since the fixing strength of the sample 1 is 2.2 kgf (21.6 N), the sample 1 has a sufficient external electrode fixing strength of at least 15 N.

Meanwhile, in the sample 2, the magnetic powder filling rate was set to be at least 65 vol % so as to improve magnetic properties. The fixing strength of the sample 2 is 0.8 kgf, which is significantly lower than the sample 1. This fixing strength is lower than 12N which is a reference value. A highly reliable electronic part cannot be obtained even if an electronic part such as a mold coil is prepared by use of the sample 2.

An object of the present invention is to provide a molded body that retains sufficient fixing strength between a magnetic mold material and an external electrode and has high magnetic properties.

SUMMARY OF THE INVENTION

To solve the above problems, a molded body of the present invention is molded by use of a magnetic mold material and an external electrode. The magnetic mold material comprises at least 65 vol % of magnetic powder and up to 35 vol % of resin. The external electrode has pits and projections on a surface that makes contact with the magnetic mold material, and spacing between the pit and the projection is smaller than the maximum particle size of the magnetic powder. The molded body has the external electrode and the magnetic mold material integrally-molded such that at least a portion of the external electrode is exposed at at least one surface of the molded body.

The external electrode used in the molded body of the present invention has pits and projections whose spacing is smaller than the maximum particle size of the magnetic powder in the magnetic mold material, on the surface that makes contact with the magnetic mold material. The magnetic powder hardly enters the pits on the surface of the external electrode. The resin, however, enters the pits easily. Accordingly, a sufficient contact area between the external electrode and the resin is secured, and high fixing strength is attained between the external electrode and the magnetic mold material. When an electronic part is prepared by use of the molded body of the present invention, a highly reliable electronic part from which the external electrode does not come off is obtained.

DETAILED DESCRIPTION OF THE PREFERRED EMBODIMENTS

Hereinafter, an embodiment of the molded body of the present invention will be described with reference to tables and the drawings. First, magnetic mold materials used in the present embodiment will be described. Characteristics of magnetic powders used in the present invention are shown in TABLE 2. Further, the compounding ratios of the magnetic powders and resins of the magnetic mold materials used in the embodiment of the present invention are shown in TABLE 3.

TABLE 2

| Material | Name of Material | Composition | Production Process | Maximum Particle Size [μm] |
|---|---|---|---|---|
| A | Iron Powder | Fe based | Carbonyl Iron Decomposition | 10 |
| B | Silicon Steel | Fe—Si based | Water Atomization | 45 |
| C | Amorphous Alloy | Fe—Si—B based | Gas Atomization | 75 |

TABLE 3

| Combination | Material | Magnetic Powder Filling Rate [wt %] | Resin Filling Rate [wt %] | Magnetic Powder Volume Filling Rate [vol %] |
|---|---|---|---|---|
| 1 | A | 85 | 15 | 49 |
| 2 | A | 90 | 10 | 61 |
| 3 | B | 85 | 15 | 49 |
| 4 | B | 92 | 8 | 66 |
| 5 | C | 85 | 15 | 49 |
| 6 | C | 93 | 7 | 69 |

In the embodiment of the present invention, materials A to C as shown in TABLE 2 are used as magnetic powders. The material A is iron powder (Fe based) obtained by thermally decomposing carbonyl iron. The material B is silicon steel (Fe—Si based) powder granulated by use of a water atomization method. The material C is amorphous alloy (Fe—Si—B based) powder granulated by use of a gas atomization method. The maximum particle sizes of the materials A to C were determined by sieve classification. The maximum particle size of the material A is 10 μm. The maximum particle size of the material B is 45 μm. The maximum particle size of the material C is 75 μm. The materials A to C were kneaded with a novolac epoxy resin in the compounding ratios shown in TABLE 3, cooled and then crushed to obtain magnetic mold materials of combinations 1 to 6.

Figure 1:
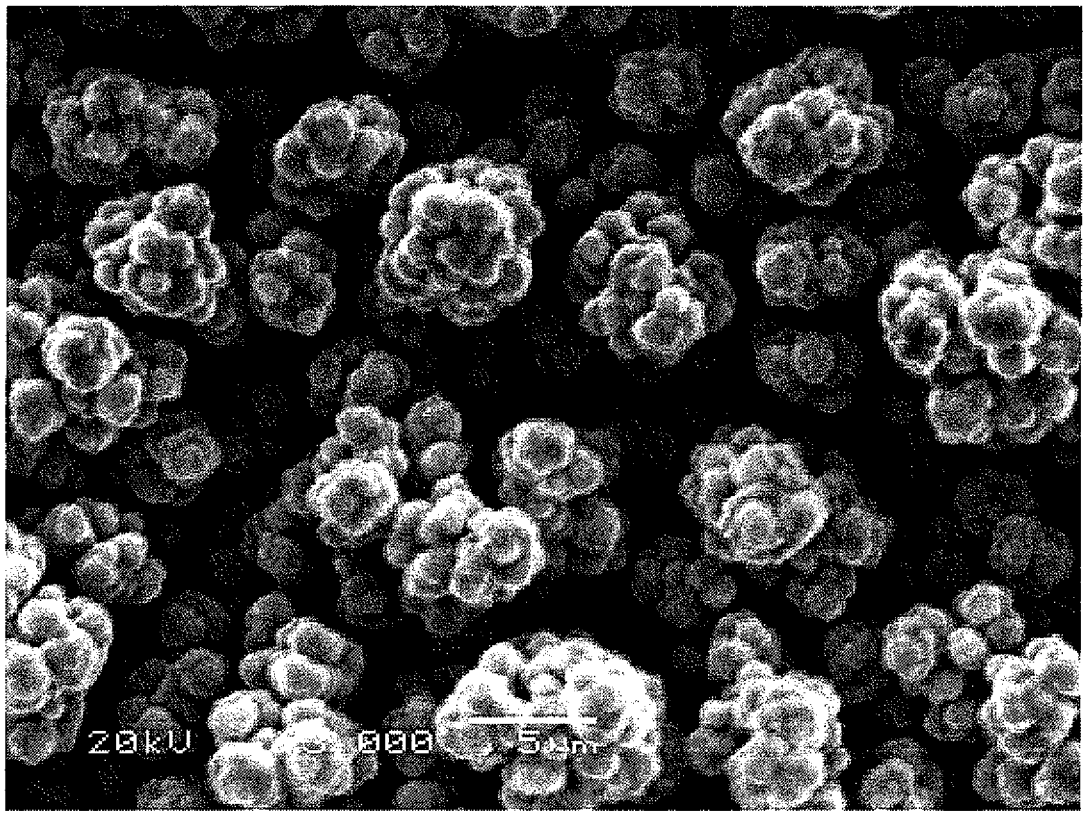
FIG. 1 is an SEM image of the surface of electrolytic metal foil used in a molded body of the present invention.
Figure 2:
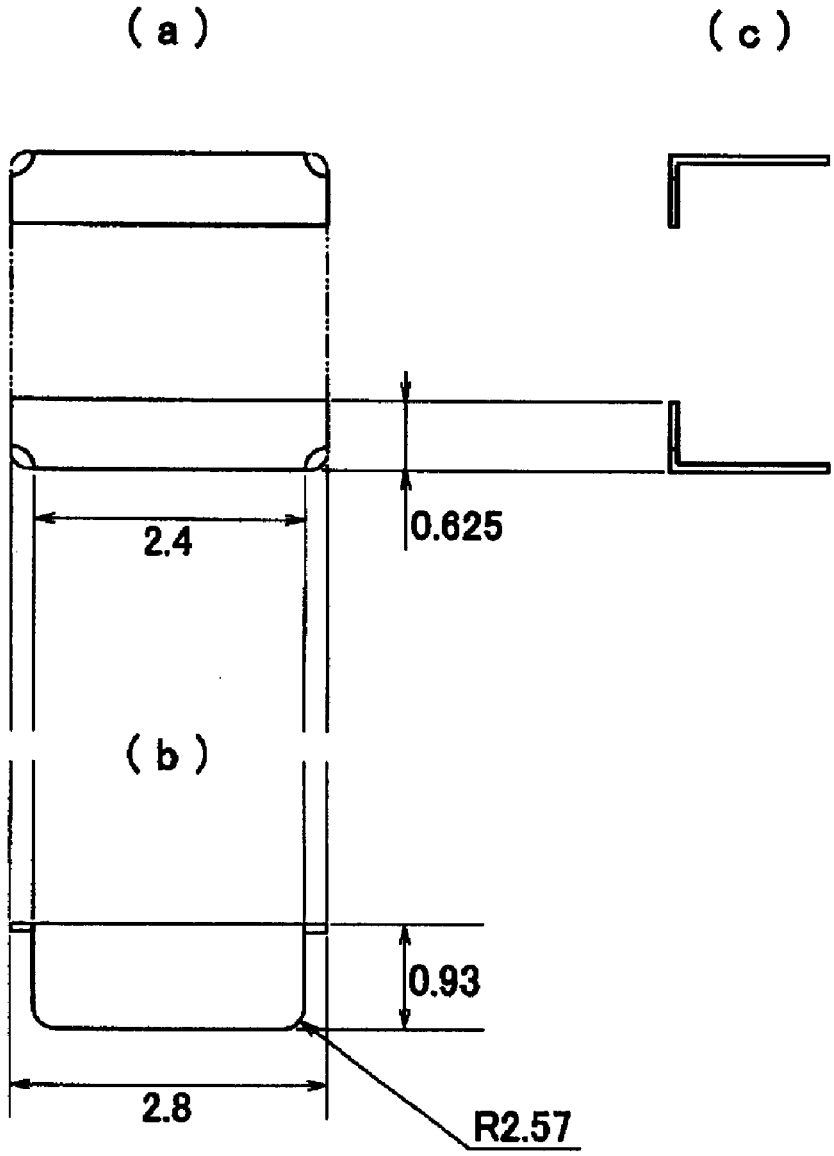
FIG. 2 is a diagram for illustrating the shape of an external electrode in an embodiment of the present invention.

Next, an external electrode used in the embodiment of the present invention will be described. FIG. 1 is an SEM image of the surface of electrolytic metal foil used in the embodiment of the present invention. FIG. 2 is a diagram showing the shape of the external electrode in the embodiment of the present invention. In the embodiment of the present invention, electrolytic metal foil (electrolytic nickel foil) having a thickness of about 35 μm is used as the external electrode. As is obvious from FIG. 1, the surface of the electrolytic metal foil has pits and projections. The pits and projections are distributed with a spacing of 10 to 40 μm therebetween, and the average spacing is 13.2 μm. This is equal to or larger than the maximum particle size of the material A but is smaller than the maximum particle sizes of the materials B and C.

The average spacing between the pits and the projections is calculated easily by use of the following method. First, the number n of tips of projections per unit area s is counted visually by use of the SEM. At that time, when nearly a half of the tip of a projection is included in the unit area s, the projection is counted as 0.5, indicating that the visual measurement is made to the order of 0.1. Then, it is assumed that the tips of the projections are arranged in a lattice configuration in the unit area s, and the average spacing is calculated. To be more specific, the distance a between the tips of adjacent projections nearest to each other can be calculated as a=(s/n)^5. Further, the distance between the tips of adjacent projections located on a diagonal of the lattice is determined as √2a. The arithmetic mean of these values is determined and taken as the average spacing between the pits and the projections in the unit area to be measured. This method is carried out at at least 3 spots on the surface of the electrolytic metal foil to calculate the average spacing between pits and projections on the surface of the external electrode.

The electrolytic metal foil is processed into a size shown in FIG. 2. The processed electrolytic metal foil functions as the external electrode. In the present embodiment, electrolytic nickel foil is used as the electrolytic metal foil. However, other electrolytic metal foil such as electrolytic copper foil may also be used as long as it has pits and projections having desired spacing therebetween.

Figure 3A:
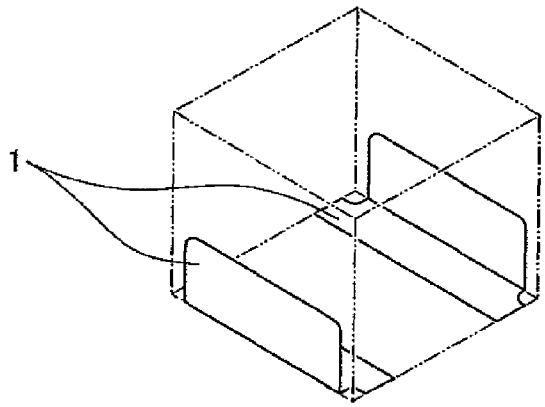
FIG. 3A is a diagram showing a portion of a production method of the molded body of the present invention.
Figure 3B:
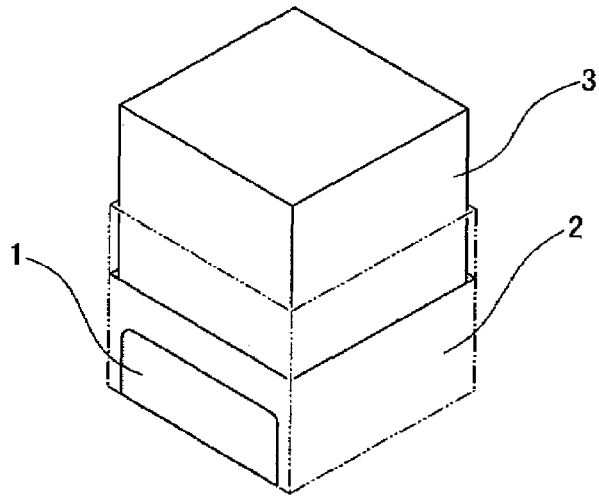
FIG. 3B is a diagram showing a portion of the production method of the molded body of the present invention.
Figure 4:
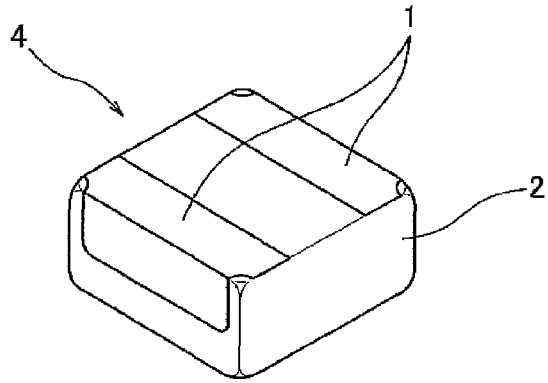
FIG. 4 is a perspective view of the molded body of the present invention.

Next, a production method of the molded body of the present invention will be described. FIG. 3 shows portions of the production method of the molded body of the present invention. FIG. 3A shows the external electrodes being set. FIG. 3B shows the external electrodes and the magnetic mold material being pressurized and cured. FIG. 4 is a perspective view of the molded body of the present invention.

As shown in FIG. 3A, external electrodes 1 are set on the bottom surface of a cavity in a mold. When the number of external electrodes is 2 as in the present embodiment, the external electrodes are so set as to face each other as shown in FIG. 3A. Then, a magnetic mold material 2 is weighed and a predetermined amount thereof is filled in the cavity in the mold in which the external electrodes 1 are set, as shown in FIG. 3B. Then, the magnetic mold material 2 is cured at 180° C. with a pressure of 100 kgf being applied by use of a punch 3. Thereafter, a molded body 4 having such a structure as shown in FIG. 4 is taken out of the mold. Further, as a comparative example, a molded body that used external electrodes made of a rolled phosphor bronze plate and having subjected to no surface unleveling treatment was obtained in the same size and manner.

Figure 5A:
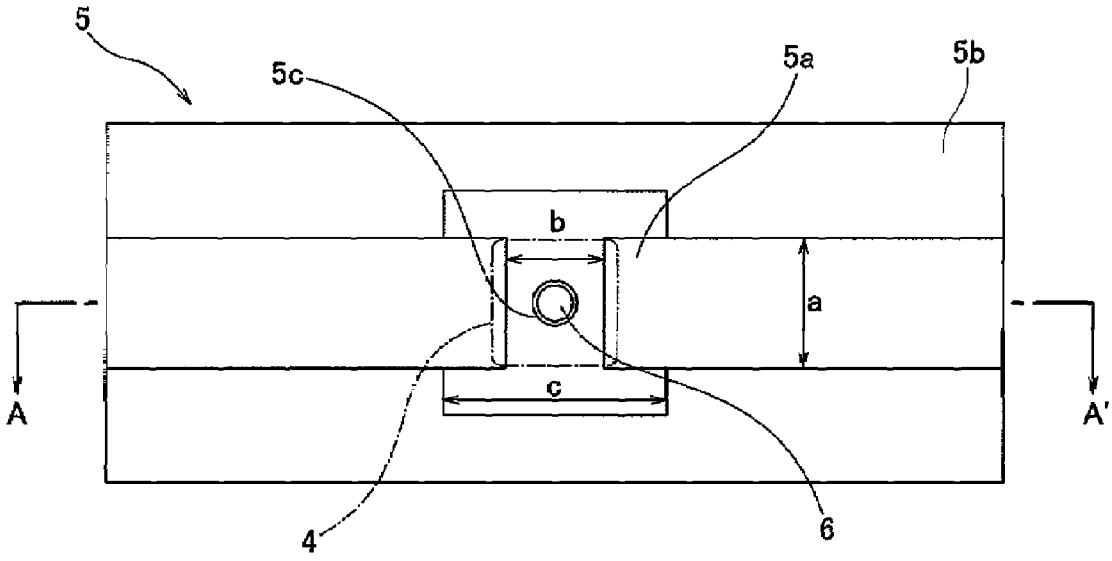
FIG. 5A is a top view of a test substrate for a push strength test.
Figure 5B:
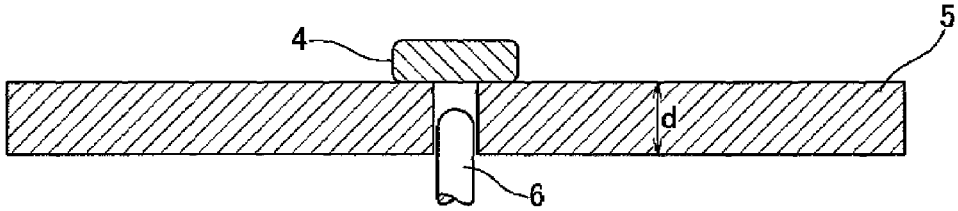
FIG. 5B is a cross-sectional view at A-A' of the test substrate for a push strength test.

Next, a push strength test (conforming to JIS C60068-2-21) of the external electrode of the molded body that is used for evaluation of the molded body will be described. FIG. 5 shows a test substrate used in the embodiment of the present invention. FIG. 5A is a top view of the test substrate, and FIG. 5B is a cross-sectional view at A-A' of FIG. 5A. In FIG. 5, 5 represents the test substrate (glass fabric base material epoxy resin laminate having copper laminated on one side). Further, 5*a* represents a conductive foil pattern, 5*b* a cover resin, and 5*c* a test substrate hole. Further, 6 represents a pushing jig. In addition, as to the sizes of a to d in FIG. 5, a is 2.9 mm, b is 2.2 mm, c is 5.0 mm, and d is 1.6 mm. Further, as the pushing jig 6, a cylindrical bar having a diameter of 0.8 mm was used.

As shown in FIG. 5, the molded body 4 is soldered such that it contacts the conductive foil pattern 5*a* formed on a surface of the test substrate 5. The pushing jig 6 is passed through the test substrate hole 5*c* in the test substrate 5 and pressed against the molded body 4 from the back side of the test substrate 5 to measure fixing strength of the external electrode. The results are shown in TABLE 4. The fixing strengths of molded bodies obtained by using each sample and a rolled phosphor bronze plate as the external electrode are also shown in TABLE 4 as comparative examples.

TABLE 4

| | | Fixing Strength [kgf] | |
|---|---|---|---|
| Sample | Combination | Rolled Phosphor Bronze Plate | Electrolytic Metal Foil |
| 3 | 1 | 1.8 | 3.6 |
| 4 | 2 | 0.9 | 1.2 |
| 5 | 3 | 2.2 | 3 |
| 6 | 4 | 0.8 | 2.2 |
| 7 | 5 | 2 | 3.7 |
| 8 | 6 | 0.5 | 2.3 |

As is clear from TABLE 4, when the conventional rolled phosphor bronze plate was used as the external electrode 1, molded bodies having a filling rate of about 50 vol % (samples 3, 5, 7) had a fixing strength of at least 12N which was a reference value irrespective of the kind of magnetic powder. However, when the magnetic powder filling rate was increased to 60 vol % or higher (samples 4, 6, 8), the fixing strengths became lower than 12N which was the reference value.

When electrolytic metal foil was used as the external electrode 1, the fixing strengths improved in all samples more than when the rolled phosphor bronze plate was used. It is assumed that since the electrolytic metal foil has more pits and projections on the surface than the rolled phosphor bronze plate, the contact area between the magnetic mold material 2 and the external electrode 1 became large and the fixing strength was improved even if the sizes of the external electrodes were the same.

In the samples 6 and 8 comprising at least 65 vol % of the materials B and C, respectively, a very high fixing strength of at least 15 N was obtained when the electrolytic metal foil was used as the external electrode 1 in place of the rolled phosphor bronze plate. The reason therefor is assumed to be that since the maximum particle size of the magnetic powder (material B, material C) is larger than spacing between pits and projections on the surface of the electrolytic metal foil, the magnetic power hardly enters the pits and the resin can preferentially enter the pits. Therefore, when the magnetic powder in the magnetic mold material has a larger maximum particle size than the spacing between the pits and the projections on the surface of the electrolytic metal foil, fixing strength between the external electrode 1 and the magnetic mold material 2 is improved dramatically even if the magnetic powder is 65 vol % or more. This is because the resin in the magnetic mold material is more liable to make contact with the surface of the electrolytic metal foil than the magnetic powder.

Meanwhile, in the sample 4, the fixing strength was not improved very much, i.e. from 0.9 kgf to 1.2 kgf, even if the electrolytic metal foil was used as the external electrode 1 in place of the rolled phosphor bronze plate. The reason therefor is assumed to be that spacing between pits and projections was larger than the maximum particle size of the material A used in the sample 4 and the magnetic powder also entered the pits easily. Since the magnetic powder has no adhesion, magnetic powder that has made contact with the external electrode 1 does not give fixing strength between the external electrode 1 and the magnetic mold material 2. Accordingly, it is assumed that when the magnetic power can enter the pits easily, both the resin and the magnetic powder make contact with the external electrode 1 evenly, so that the fixing strength is not improved very much.

Thus, when a molded body is obtained by integrally-molding a magnetic mold material comprising at least 65 vol % of magnetic powder and an external electrode, use of an external electrode having pits and projections whose spacing is smaller than or equal to the maximum particle size of the magnetic powder on the surface achieves sufficient contact between the surface of the external electrode and a resin and gives high fixing strength therebetween.

Then, an external electrode (electrolytic metal foil or rolled phosphor bronze plate) and magnetic mold materials of combinations 1, 2, 5 and 6 were used to obtain molded bodies by transfer molding. The shapes and sizes of the molded bodies and external electrodes are the same as those in press molding. The molded body obtained from each sample was subjected to a push test. The results are shown in TABLE 5.

TABLE 5

| | | Fixing Strength [kgf] | |
|---|---|---|---|
| Sample | Combination | Rolled Phosphor Bronze Plate | Electrolytic Metal Foil |
| 9 | 1 | 2 | 3.8 |
| 10 | 2 | 0.6 | 1.2 |
| 11 | 5 | 1.8 | 3.7 |
| 12 | 6 | 0.6 | 2.4 |

As is clear from TABLE 5, the same results as those in press molding were obtained even when moldings were conducted by transfer molding. It is also possible to mold the molded body of the present invention by use of transfer molding.

What is claimed is:

1. A molded body having an external electrode and a magnetic mold material integrally-molded such that at least a portion of the external electrode is exposed at at least one surface of the molded body, wherein the magnetic mold material comprises at least 65 vol % of magnetic powder and up to 35 vol % of resin, the external electrode has pits and projections on a surface that makes contact with the magnetic mold material, and spacing between the pit and projection of the external electrode is smaller than the maximum particle size of the magnetic powder.

2. The molded body of claim 1, wherein the external electrode is electrolytic metal foil.

3. The molded body of claim 1, wherein the external electrode comprises electrolytic copper foil or electrolytic nickel foil.

* * * * *